US005392771A

United States Patent [19]

Mock et al.

[11] Patent Number: 5,392,771

[45] Date of Patent: Feb. 28, 1995

[54] UNDERWATER MONITORING AND COMMUNICATION SYSTEM

[75] Inventors: Markus Mock, Uster; Ernst B. Voellm, Kilchberg, both of Switzerland

[73] Assignee: Uwatec AG, Hallwil, Switzerland

[21] Appl. No.: 861,832

[22] PCT Filed: Oct. 18, 1991

[86] PCT No.: PCT/EP91/01982

§ 371 Date: Aug. 17, 1992

§ 102(e) Date: Aug. 17, 1992

[87] PCT Pub. No.: WO92/06889

PCT Pub. Date: Apr. 30, 1992

[30] Foreign Application Priority Data

Oct. 19, 1990 [DE] Germany ..... 4033292.6

[51] Int. Cl.[6] ..... A62B 7/00; A62B 9/00; B63C 11/02; G08B 3/00

[52] U.S. Cl. ..... 128/205.23; 128/205.22; 128/201.27; 128/202.22; 367/6; 367/21; 367/77; 340/297; 340/298

[58] Field of Search ..... 128/201.19, 201.27, 128/202.22, 202.27, 204.18, 204.21, 204.22, 204.26, 204.29, 205.22, 205.23, 204.23; 367/6, 21, 77; 340/297, 298

[56] References Cited

U.S. PATENT DOCUMENTS

| | | | |
|---|---|---|---|
| 3,517,316 | 6/1970 | Anderson et al. | 376/6 |
| 3,668,617 | 6/1972 | Brainard, II | 340/4 E |
| 3,696,384 | 10/1972 | Lester | 376/6 |
| 3,717,844 | 2/1973 | Barret et al. | 376/6 |
| 3,764,966 | 10/1973 | Abbagnaro | 340/14 |
| 4,020,449 | 4/1977 | Ito et al. | 340/15 |
| 4,101,873 | 7/1978 | Anderson et al. | 376/6 |
| 4,549,169 | 10/1985 | Maura et al. | 340/539 |
| 4,563,758 | 1/1986 | Paternostro | 128/201.27 |
| 4,577,333 | 3/1986 | Lewis et al. | 375/45 |
| 4,583,073 | 4/1986 | Stolowicki | 340/310 A |
| 4,634,043 | 1/1987 | Cole et al. | 340/825.54 |
| 4,636,791 | 1/1987 | Burke et al. | 340/825.52 |
| 4,658,358 | 4/1987 | Leach et al. | 128/201.27 |
| 4,776,332 | 10/1988 | Wenzel et al. | 128/201.27 |
| 4,885,797 | 12/1989 | Leather et al. | 455/40 |
| 4,949,072 | 8/1990 | Comerford et al. | 128/201.19 |
| 4,999,606 | 3/1991 | Comerford et al. | 128/201.19 |
| 5,185,725 | 2/1993 | Kent et al. | 376/6 |
| 5,191,317 | 3/1993 | Toth et al. | 128/201.22 |

FOREIGN PATENT DOCUMENTS

| | | | |
|---|---|---|---|
| 0360671 | 3/1990 | European Pat. Off. | 340/825.52 |
| 8100496 | 2/1981 | WIPO | 340/825.52 |
| 8806549 | 9/1988 | WIPO | 128/201.19 |

OTHER PUBLICATIONS

Diver, vol. 11 No. 2, pp. 5, 20–22 and front cover (Mar. 1985).

*Primary Examiner*—Kimberly L. Asher
*Attorney, Agent, or Firm*—Parmelee, Bollinger & Bramblett; George W. Rauchfuss, Jr.

[57] ABSTRACT

A monitoring device for portable breathing apparatuses having a manometer by means of which the pressure in the pressure container of the breathing apparatus is detected, and having a transmitter by means of which a signal corresponding to the pressure is transmitted at regular intervals. The transmitter also has a signal generating device which generates an identification signal which is characteristic of the transmitter. The pressure signal and identification signal are received and tested by a receiver. If the identification signal matches an identification comparison signal stored in the receiving device, the measured pressure value is displayed on a display device.

30 Claims, 6 Drawing Sheets

| PRÄAMBEL | IDENTIFIKATIONS-SIGNAL | DATEN | POSTAMBEL |
|---|---|---|---|
| 16 BIT | 24 BIT | 32 BIT | 4 BIT |

FIG.5

| PRÄAMBEL | IDENTIFIKATIONS-STEUER-SIGNAL | IDENTIFIKATIONS-SIGNAL | POSTAMBEL |
|---|---|---|---|
| 16 BIT | 24 BIT | 24 BIT | 4 BIT |

FIG.6

UNDERWATER MONITORING AND COMMUNICATION SYSTEM

BACKGROUND OF THE INVENTION

The present invention relates to a monitoring device for portable breathing apparatuses. Portable breathing apparatuses of this kind are used for example by divers, by fire fighters when fighting fires or generally whenever air is charged with noxious substances which make unaided breathing impossible. Portable breathing apparatuses usually consist of one or two metal bottles which are carried for example on the back of the user and in which a highly compressed oxygen gas mixture at a pressure of for example 350 bar is contained. This oxygen gas mixture is designated below, for the sake of simplification, as breathing air or simply as air. The breathing air is removed from the bottles via a shut-off valve and breathed in by the user by means of a so-called demand valve.

The problem in using breathing apparatuses of this kind is initially described by reference to the example of scuba diving:

In professional scuba diving today depths of over one hundred meters are reached and, even when diving as a hobby, experienced divers go down to considerable depths.

As the depth of water increases, the hydrostatic pressure acting on the diver becomes greater, which leads to the body tissues absorbing a relatively high amount of inert gases, that is to say in particular nitrogen. During resurfacing and the associated pressure reduction this process is reversed. If the pressure reduction occurs more quickly than the gas, which is being released, can be carried off and breathed out, decompression sickness occurs which in less severe cases leads to temporarily-health but in more severe cases can lead to permanent damage to health and even to death. In order to prevent a rapid release of the inert gases, when returning to the surface after a relatively long time spent at a relatively great depth divers must therefore remain at specific depths for relatively long resurfacing interludes which are referred to as so-called decompression stops. The duration of the necessary decompression stops is difficult to calculate since the human body has a multiplicity of different types of tissue which differ both with respect to the saturation and desaturation behavior as a function of the diving depth and duration of diving and also with respect to the medical hazard. Therefore, divers usually use diving tables in which the decompression times are given as a function of the diving depth reached and the duration of diving or they use diving computers in which the saturation and desaturation behavior of a selected number of types of tissue are mathematically simulated and the decompression times thus calculated are displayed to the driver via corresponding display devices.

A summary of the problems of decompression is given, for example, by the publication by A.A. Bühlmann: Decompression—Decompression Sickness, Berlin, Heidelberg, New York, Tokyo 1984, ISBN 3-540-13308-9, specifically in particular pages 1–62 for the medical aspect and pages 63–67 for the decompression calculation. Pages 68–82 contain decompression tables for divers.

Therefore, before the diver undertakes such a dive he must ensure that the air supply he carries is adequate for the planned bottom time and for the ascent time.

However, determining the required air supply is faced with considerable difficulties: the amount of air taken in by the diver per minute is not constant but changes, for example with the physical stress. In states of fear and panic, the air consumption can increase suddenly as a result of so-called hyperventilation. Furthermore, the amount of air removed is, of course, dependent on the respective ambient pressure and thus depends on how deep the diver is diving.

Therefore, the diver requires a monitoring device to be able to estimate the actual air consumption and the remaining possible bottom time under water.

Currently, in order to monitor the air supply divers use manometers which are connected to the breathing apparatus via a hose and indicate the current pressure of the air supply in the container. Since the pressure drops as air is continuously removed from the bottle, the appropriately experienced diver can estimate to a certain degree how much breathing time remains.

It has also already been proposed, see for example U.S. Pat. Nos. 4,794,803 or 4,586,136, to design a monitoring device which enables the remaining time available to the diver to be determined and indicated directly from the measured bottle pressure. However, these devices have the disadvantage that they are connected to the breathing apparatus via a hose and are thus cumbersome to operate and in addition can adversely affect the freedom of maneuver of the diver.

In order to overcome this problem, it has been proposed in the Australian Patent Document AU-B-78218/87 to provide, instead of the hose, an ultrasonic transmission between the pressure sensor on the bottle and a display device. In this case, the receiving and display device is arranged on the diver's mask.

The use of such monitoring devices, in particular when they operate with a wireless signal transmission, is however only acceptable if certain safety requirements are fulfilled.

Thus, it must be ensured that the signal transmission from the transmitter to the receiver takes place correctly under all circumstances, that is to say that movements of the diver and the water, that is to say external interference etc., do not have any influence on the transmission of the measurement signal.

At the same time, it is to be borne in mind that intellectual capacities are impaired from a depth of about 30 meters by the high N2 partial pressure which has a kind of narcotic effect (nitrogen narcosis). If the monitoring device, for example, falsely indicates an excessively low air supply, this can lead to an irrational panic-like reaction even among experienced divers. Therefore, it should be ensured as far as possible that the monitoring device does not display a false signal, even for only a brief period of time.

The problems described above relating to scuba diving also apply, in a correspondingly modified manner, to the use of breathing apparatuses for fire-fighting and rescue operations and for other applications. Here too, the user requires the remaining breathing time to be specified exactly in order, for example, to be able to begin his return to safety at the correct time. Furthermore, the user here is also usually in a particularly stressed state and it must therefore be ensured that incorrect measurements and incorrect information are avoided as far as possible.

SUMMARY OF THE INVENTION

The present invention is therefore based on the object of providing a monitoring device for portable breathing apparatuses by means of which the user is informed at least about his air supply and which operates reliably and in particular free of external interferences and whose display is easy to read.

This object is achieved according to the invention by means of the subject-matter of claim 1.

Preferable further developments of the device are the subject-matter of subclaims.

The monitoring device according to the invention consists of a transmitter and of a receiver separate therefrom. This design has the advantage that the receiver, which is usually combined directly with the display device, can be arranged in the field of vision of the user without his freedom of maneuver being unnecessarily restricted, for example by means of a hose device, and without a special manipulation being required to read the display device.

The receiver can thus be carried by the user in any desired manner. It is preferable for the receiver to be arranged directly on the user's wrist. This has the advantage over an arrangement on a mask that the user does not have any focussing difficulties when reading the display. Furthermore, he does not have the display instruments constantly in his field of vision, which could confuse or distract him. The arrangement on the wrist permits the user to read the appropriate, displayed data easily when, for example, he is carrying out any tasks with his hands.

However, on the other hand, wireless signal transmission entails considerable risks for the reliability of the signal transmission. With this design, the receiver could interpret interference signals, such as are caused, for example, by movements of the diver or also by external sources, as a pressure signal and thus display false or frequently changing values to the user. The user would then no longer be able to read the data reliably.

A risk which is associated with wireless transmission and is not to be underestimated is also due to the fact that the operations or dives in question are not normally undertaken alone but rather that several persons carry out the operation or dive together. Since identical apparatuses are frequently used within a rescue organization or a diving club for all the members of such a group, there is a very high risk that a receiver will pick up the signals of a neighbour's transmitter and thus display false values to the user.

It is possible to solve the problem of the use of several monitoring devices within a group by assigning to each device an individual transmission frequency which can only be received by a correspondingly tuned receiver. However, this design has several disadvantages. If a relatively large number of such monitoring devices with differing frequencies were to be made available, the frequency band still available for the individual device would have to be tightly dimensioned. However, this requires a relatively high degree of technical complexity with regard to the receiver in order reliably to filter out from a plurality of received frequencies that frequency which is intended for each respective receiver. As a result, the receiver becomes complex and the probability of potential errors increases.

Also the fact that the intensity of the received signals decreases with distance is not sufficient to ensure in this case a clear allocation of the devices.

Firstly, it would only be possible to achieve an intensity of reception which was constant to some extent if the transmitter and receiver were arranged at a relatively short distance from one another and always had the same spatial arrangement with respect to one another. However, this is not even the case if the transmitter is installed on the pressure container and the receiver is installed in the region of the head or, for example, of a mask of the user. In this case, even turning the head is sufficient to change the spatial arrangement and thus the intensity of reception. If the transmitter is installed on the pressure container and the receiver on the wrist of the user, severe fluctuations in the intensity of reception are to be expected as a function of the movement of the user. Moreover, further interference, for example air bubbles when diving, can additionally affect the intensity of reception.

Moreover, the distance between different users, for example when they are recovering objects or rescuing people, may be very small so that the distance-related difference in intensity is no longer significant. This applies for example if a diver tries to help a colleague in difficulty.

The monitoring device according to the invention solves these problems reliably. By the use of an identification signal it is ensured that each receiving device only receives and further processes the signals which are emitted by the associated transmitting device. In this way, it is not only the case that signals from other devices are prevented from being received; it is also the case, by virtue of the strictly predetermined identification pattern, that the signals which originate from external interference, for example from any other transmitters, are prevented from being further processed. In this way, it is ensured that only that signal is further processed which corresponds exactly to the respective identification pattern. It is very improbable that interference signals from any other transmitters contain corresponding identification patterns.

According to a preferred embodiment, the transmission of the data and of the identification signal takes place in digital form. As a result, a relatively high degree of data transmission reliability is achieved and it is also possible to select a high number of identification patterns by virtue of the fact that this signal is composed of a correspondingly high number of individual bits.

It is possible for a specific receiving component to be assigned to each transmission element and vice versa, as early as during production. However, this has the disadvantage that, for example in the event of a failure of the receiving element, the associated transmitting element also becomes unusable and vice versa. According to a preferred further development of the invention, it is therefore proposed to make the assignment between the transmitting element and receiving element variable.

In this case, provision is preferably made for the transmitting element and the respective receiving element to be used with it to be capable of being placed in an identification signal change mode which permits the receiving element to receive and store the identification signal of the transmitting element assigned to it. According to a preferred further development, this assignment or pairing mode has several safety steps so that unintentional and incorrect assignment of a transmitting element and receiving element is avoided.

According to a preferable further development, the transmitting and receiving elements are designed in such a way that the identification signal change mode is always triggered by one device, and preferably by the transmitting element, this device then preferably also having a fixed, invariable identification signal.

The possibility of the free assignment of transmitting element and receiving element has considerable advantages in practical use. Organizations such as, for example, a diving club, a fire-fighting unit and the like usually have a number of portable breathing apparatuses which, when using a monitoring device according to the invention, are each provided with a transmitting element and a receiving element. If, in such a group, for example one transmitting element and one receiving element of a non-assigned pair fail, a total of two monitoring devices would become unusable in the case of an invariable assignment. When using a variable assignment, the remaining devices could continue to be used.

It is also ultimately not necessary to store the transmitting element and receiving element in each case in such a way that it is impossible to mix up the devices. If it is found that the devices do not match, a new assignment can be performed at any time.

Furthermore, in particular if the monitoring device is to be used for diving, the battery which is necessary both for the transmitting element and receiving element must be arranged in a pressure tight manner in the respective housing and can thus not be changed by the user himself. Since it is to be expected that the batteries of the transmitting element and receiving element are used up at differing rates as a function of the respective use profile, both devices of such a combination would be out of operation for the time of the battery change of a device which can usually only be performed by the manufacturer. This disadvantage is also avoided by the variable assignment.

The variable assignment also has the advantage that two receiving device can also be assigned to a transmitting device. It is then possible for example for a diving instructor to use two receiving devices with which he can observe his air supply and the air supply of a trainee diving with him. If the devices are to be additionally provided with an air consumption measuring device, the diving instructor can also evaluate the state of stress of his trainee from this display.

Finally, it is also conceivable that, in particular for the receiver which can be combined with other functions, differing device models will be offered which the user will be able to use without having to obtain a new transmitting element in each case. In addition, the manufacture of the monitoring device is substantially simplified by the variable assignment.

The identification signal change mode is preferably triggered by the transmitter being made, manually, to emit a fixed signal (the identification control signal) which indicates to the receiving device that an assignment process is to take place. In order to prevent the assignment of a plurality of receiving devices to one transmitting device, appropriate safety measures can be provided with regard to the receiver.

The actual assignment takes the form of the identification signal of the transmitting element also being emitted with the identification control signal. The receiving device which has been placed in the identification signal change mode receives this identification signal and stores it in a corresponding memory until it receives a different identification signal within the scope of a new assignment.

It is improbable that any third transmitter emits a pattern which corresponds to the identification signal. The small remaining uncertainty factor can be greatly reduced by means of a further safety measure which also serves to eliminate the effect of signal interference such as is caused, for example, by movements of the diver.

One of the preferred aims of the monitoring device is to calculate the breathing time still available to the user of the breathing apparatus. This breathing time is preferably calculated by means of a computing device which is installed either in the transmitting device or in the receiving device. As a result, it can be indicated to the user of the breathing apparatus how long the breathing air will last under the current conditions.

In accordance with a preferable further development of the invention, this computing device is installed in the receiving element and continues the air consumption calculation in the manner of a prognosis if no signal is received from the transmitting element. As a result, a signal which is received after an interruption can be tested for its plausibility.

If, therefore, as a result of a fault, the receiver does not receive a signal, it extrapolates the air consumption on the basis of the preceding measurements until the next signal is reliably received. Then a check is carried out as to whether this received signal lies in a specific tolerance range of the extrapolated air consumption. If this is the case, the signal is displayed as a new value. If this is not the case, no display is given. Also, for as long as the reception situation is unclear, it is also preferable for no display value to be given.

This design has the advantage that the receiver can be reliably prevented from displaying a false value, due to an incorrectly received signal, which could confuse the user.

The transmission of the signals from the transmitting element to the receiving element can take place with all the methods suitable for signal transmission. If the monitoring device is used under water, the data transmission can take place with ultrasonic sound. However, when using the device under water the use of radio signals, and here in particular the use of signals in the long wave range is preferred, that is to say the use of radio signals of a frequency of 5 hertz to 100 kilohertz.

Investigations carried out by the inventor have shown that for electromagnetic transmission of the signal in water a frequency range between 5 hertz and 50 kilohertz is particularly suitable for transmitting the desired signals.

Both the transmitting element and receiving element can be provided with further functions.

If the monitoring device is used when diving, according to a preferable further development of the invention it can be combined with a decompression computer. This computer is preferably accommodated in the receiving element and is connected to a pressure sensor which measures the hydrostatic pressure of the water and thus the diving depth. In addition, a further timer is provided by means of which the diving time can be measured. By means of a computer circuit the saturation or desaturation behavior are determined for an infinite number of tissue types from the measured values of diving depth and diving time, as is illustrated for example in the quoted work by Bühlmann. It can be determined from these values and displayed to the diver how long the ascent to the surface of the water will last overall and at which depths, and for how long, decompression stops are to be included during this process. By combining the calculation of the decompression times with the air consumption calculation, it can then be calculated and displayed to the diver how long he can stay at the appropriate diving depth level before he must begin his ascent again in order to have a sufficient air supply available for an ascent free from medical risks.

From medical research into diving it is known that the saturation and the desaturation of the tissues does not depend only on diving depth and diving time but is also dependent on whether the diver has had to exert himself physically or not. If the diver carries out work during the dive, the required decompression times may rise by up to 50%. A corresponding increase in the decompression times can also result if the diver, for example when diving as a hobby, does not perform any actual task but must, for example, maintain his position against a relatively strong current so that a relatively high level of physical exertion is also required.

According to a preferred further development of the present invention, the physical exertion is included in the decompression calculation with the aid of the monitoring device according to the invention. The air consumption measurement is used as a measure of the exertion. At the same time, the air consumption measurement can take place both relatively and absolutely.

In an absolute air consumption measurement, it is calculated from the pressure reduction with a known bottle volume what quantity of air the diver is taking in per unit of time. From this value conclusions are made with respect to an average or an increased level of physical exertion which can then be taken into account during the decompression calculation.

In the relative air consumption measurement, it is simply determined how high the average air consumption of the diver is, which is averaged over a specific period of time. If the air consumption increases in comparison with this value, an increased level of physical exertion is assumed.

Both absolute and relative air consumption measurements can be continued during the dive in order to influence the decompression calculation further. As a result, it is possible to detect physical exertion during the decompression phase which usually shortens the decompression time. In addition to air consumption measurement, the pulse frequency of the diver can also be detected by means of a corresponding sensor and transmitted to the decompression meter. The pulse frequency also supplies a measure of physical exertion. If the pulse frequency is picked up for example via electrodes which are arranged in the chest area of the diver, the values can be passed on, for example by means of a cable connection, to the transmitting device on the air bottle and transferred in a wireless fashion from there with the monitoring device to the receiving device worn on the wrist.

When using a monitoring device in fire-fighting and rescue operations, a plurality of additional functions can also be integrated in the receiving element. Thus, in addition to the display of current pressure in the pressure container of the breathing apparatus, the remaining breathing time and/or the breathing frequency can be calculated and displayed. In addition, it is possible to provide measuring sensors in the receiving device which give information to the user relating to the state of the air surrounding him. Thus, for example when fire-fighting, the carbon monoxide portion of the air is measured and displayed so that the user of the breathing apparatus is informed for example as to the risk facing those people to be saved. Of course, in addition to gas detectors, sensors for all other types of measurable harmful influences can however also be used (for example Geiger counters and the like).

BRIEF DESCRIPTION OF THE DRAWINGS

An exemplary embodiment of the present invention is now described with reference to the figures, in which:

FIG. 5 shows a diagrammatic view of the structure of the transmission signal during normal operation of the exemplary embodiment according to FIG. 1;

FIG. 6 shows a diagrammatic view of the structure of the transmission signal in the identification change mode of the exemplary embodiment according to FIG. 1;

DESCRIPTION OF THE PREFERRED EMBODIMENTS

The first exemplary embodiment of the invention presented in FIGS. 1 to 7 is provided for use with the breathing apparatus for a diver. However, if appropriate it can also be used with corresponding modifications for breathing apparatuses such as are also used for example for fire-fighting and rescue operations.

Figure 1:
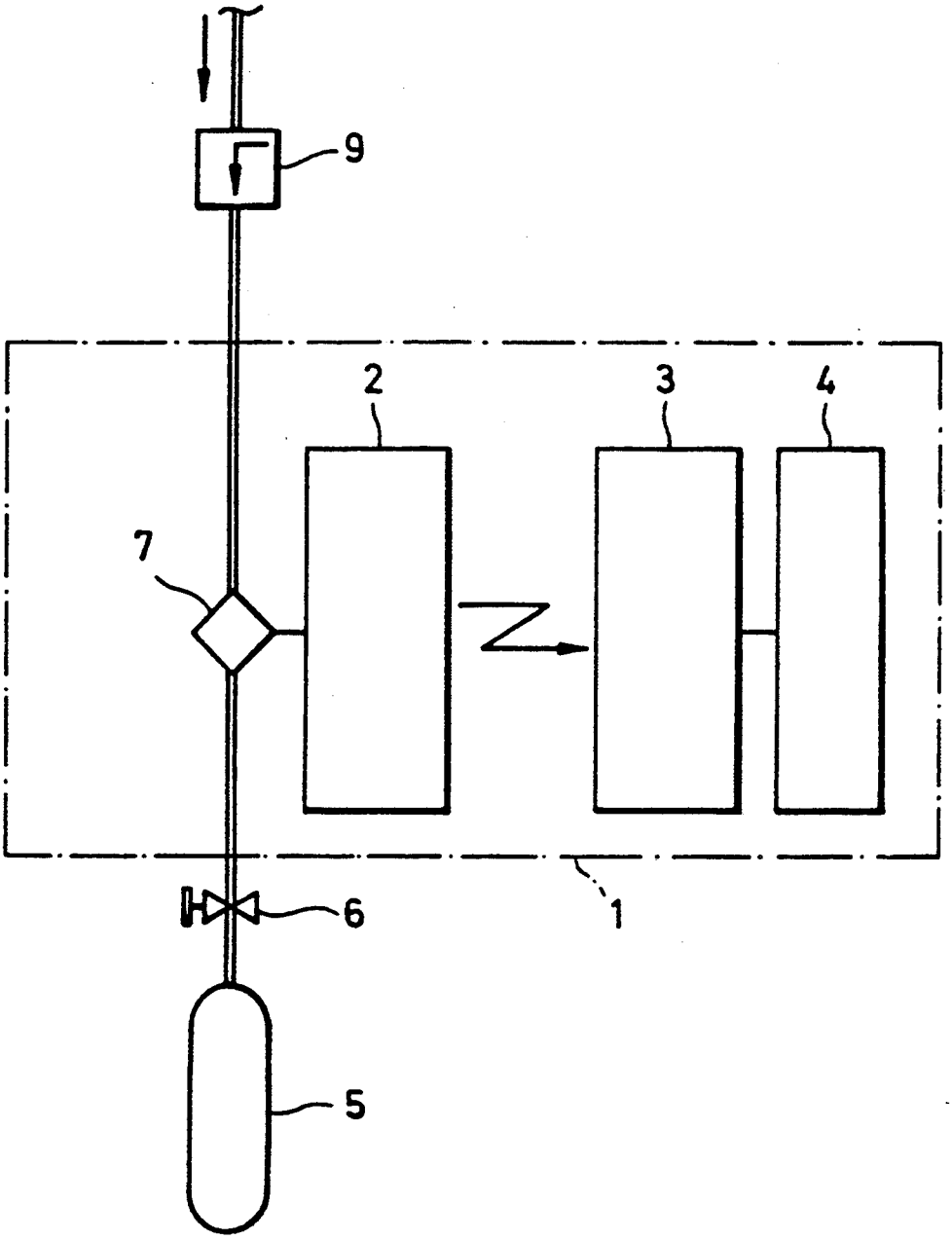
FIG. 1 shows a diagrammatic functional view of a portable breathing apparatus with an exemplary embodiment of the monitoring device according to the invention.

FIG. 1 shows a highly diagrammatic view of the monitoring device which is designated as a whole by 1 and which has a transmitting element 2, which contains the transmitter, and a receiving element 3, which contains the receiver.

In the present example (not shown in the figures) the transmitting element 2 is permanently attached to an air bottle 5. The air bottle is a conventional steel bottle with a volume of, for example, 7 to 18 liters and a maximum storage pressure of, for example, 350 bar which can be closed off with a manually actuated shut-off valve 6. During use, the shut-off valve 6 is open and the pressure of the air fed to the user is controlled via a diagrammatically indicated pressure control valve 9. This valve 9 which is usually referred to as a demand valve can have one of the different designs which are known in the prior art. The user then takes the air from the breathing apparatus via a hose connection (not shown) by means of a mouthpiece.

A pressure sensor 7 which detects the pressure prevailing in the bottle is arranged between the shut-off valve and the demand valve. The arrangement of the pressure sensor downstream of the shut-off valve 6 has the advantage that the pressure sensor is not subjected to the apparatus pressure during storage of the bottle;

furthermore, as is explained below, this has advantages for the safety design of the monitoring device.

When in use, the receiving element 3 is used at a spacial distance from the transmitting element 2 and is coupled to a display device 4 which is usually integrated directly in the housing of the receiving element.

Figure 2:
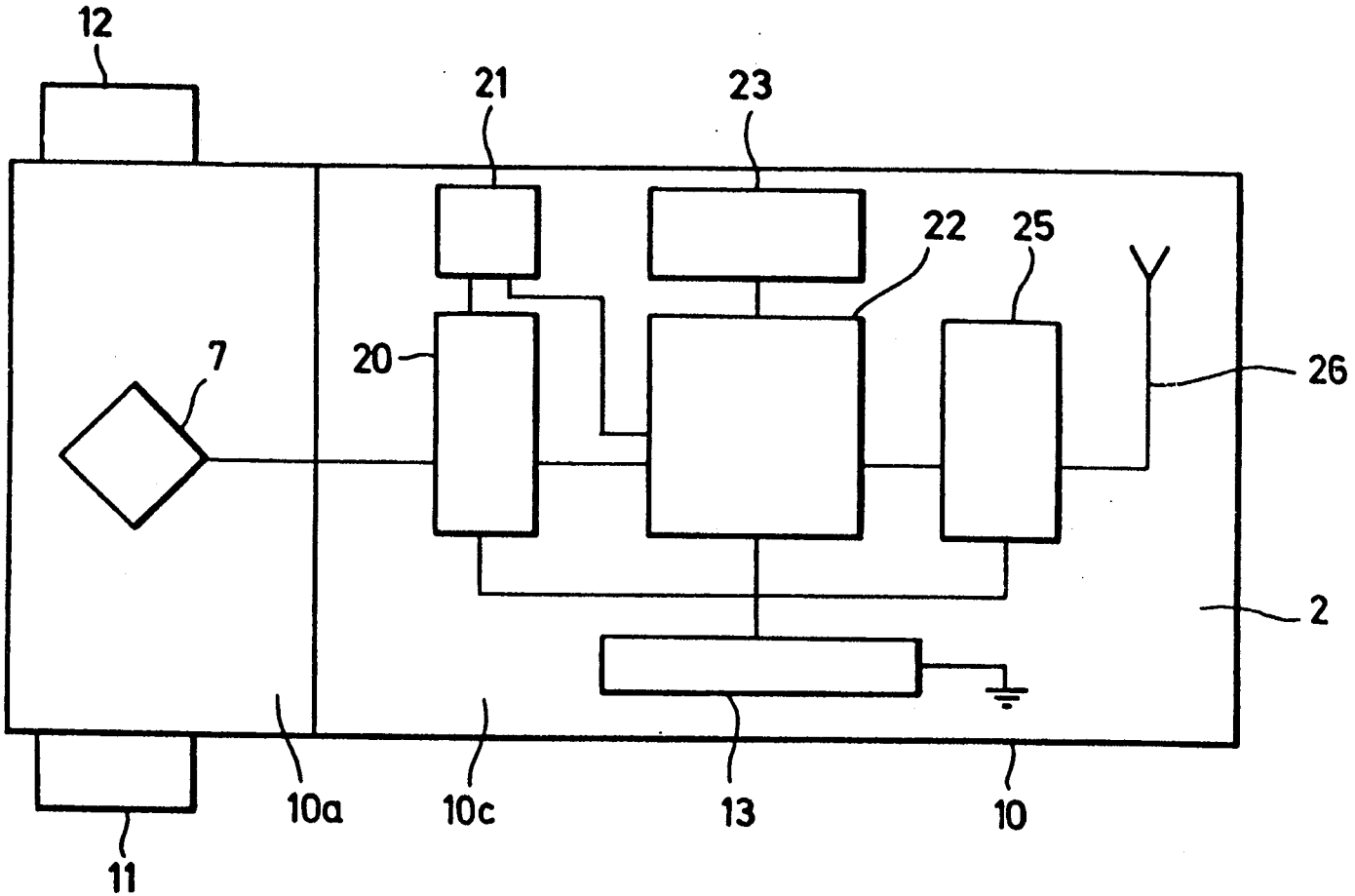
FIG. 2 shows a diagrammatic view of the transmitting element of the exemplary embodiment according to FIG. 1.

The transmitting element 2 illustrated diagrammatically in FIG. 2 has a housing 10 consisting of nonmagnetic material, preferably plastic, in which the electrical and electronic constructional elements of the transmitting element are held. The interior of the housing 10 of the transmitting element 2 is completely filled with electrically non-conductive oil, silicone or the like. The area of the housing 10*a*, in which the pressure sensor 7 is arranged, is designed in such a way that during use it is subjected to the pressure in the bottle 5. This is diagrammatically illustrated by the connecting pieces 11, 12. The other part 10*b* of the housing is also sealed in order to avoid the ingress of water.

In addition, a battery 13 which supplies the transmitting element with electrical power and which is thus also subjected to the pressure in the housing is accommodated in the housing 10.

The configuration of the electrical components of the transmitting element is now described with reference to FIG. 2.

The pressure sensor 7 is connected to a signal preprocessing circuit 20 with electrical lines which are only illustrated diagrammatically here and below. All commercially available types of sensor can be used as the pressure sensor provided that they can be operated with a battery voltage of less than 5 V and use as little power as possible. Therefore, pressure sensors which operate according to the piezoelectric principle are particularly preferred.

The analog signal of the pressure sensor is converted in the signal preprocessing circuit 20 into a digital signal by means of an analog-to-digital convertor. The signal preprocessing circuit 20 is also connected to a quartz-controlled timer 21 whose function is explained below. The digitally preprocessed signal is fed to a commercially available microprocessor computing unit 22. The microprocessor computing unit 22 is connected to a memory 23 and also receives the signals from the timer 21. The memory 23 (and the corresponding memory in the receiving element) can be made up completely from RAM elements. However, it is also possible to use a mixed memory consisting of ROM (read-only memories) and RAM elements. Since the battery voltage is permanently available, the memory contents can be ensured over a long period of time even when using volatile memory elements.

The pressure signal and the other signals to be transmitted are converted by the microprocessor 22 into a transmission signal in accordance with a program stored in the memory 23 and fed to a transmission output step 25. From the transmission output step 25 the signal is transmitted to the aerial 26.

The aerial 26 consists of a ferrite core wrapped with copper wire. An inductivity of the transmission coil in the range between 10 and 50 mhenry has proven particularly favorable.

Figure 3:
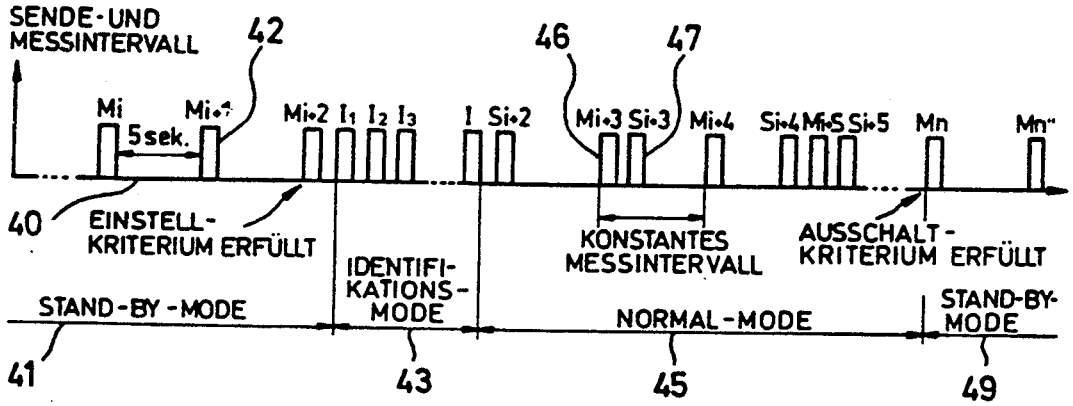
FIG. 3 shows a diagrammatic view of the functional modes of the transmitting element of the exemplary embodiment according to FIG. 1.

Different operating modes of the transmitter are now described with reference to FIG. 3 in which the various functional modes of the transmitting element are plotted against the time axis 40.

In the time period 41 in the left-hand part of the figure, the transmitter is in the standby mode. In this mode, the signal preprocessing circuit is made to carry out a pressure measurement at specific time intervals, which is characterized by columns 42. A time period of approx. 5 sec. has proven a preferable time interval here. Between two measurements the microprocessor 22 is always switched into a standby mode in which it only uses a very small degree of power. As a result, it is possible to operate the transmitting element with a typical use profile for approximately five years with one lithium battery.

The starting signal for the pressure measurement originates from the timer 21 of the transmitter. The microprocessor 22 is subsequently activated and the pressure measured by means of the pressure sensor 7.

As soon as a specific switch-on criterion is fulfilled, the transmitter is switched over from the standby mode into the transmission mode. Various criteria can be used as the switch-on criterion. It has proven particularly advantageous to compare the results of two successive pressure measurements and to switch over into the transmission mode in the case of a pressure rise. Preferably, the switch-on criterion is dimensioned in such a way that the transmission mode is switched on if a rise of pressure from below 5 bar to, for example, 30 bar or higher is detected within five seconds. This rise is achieved in any case when the user of the breathing apparatus opens the shut-off valve 6 of the bottle 5 and thus subjects the pressure sensor 7 to the bottle pressure. Random pressure fluctuations, such as arise for example due to temperature changes, changes in altitude etc., are not sufficient to fulfill this switch-on criterion.

After switching on, a so-called identification change mode or pairing mode, which is explained later, takes place initially in the time period 43.

The identification change mode is followed by the actual normal mode in time section 45 which constitutes the actual use phase of the apparatus. As is diagrammatically illustrated in FIG. 3, in this mode a measuring interval 46 alternates with a transmission interval 47. It has proven favorable also to operate with a time interval for the pressure measurements of five seconds during the normal mode. After each measured value is recorded, the transmission signal is then generated by the microprocessor and fed to the aerial 26 via the transmission output step 25.

The time interval between the pressure measurement and the transmission of the signal is not constant but rather is varied by the microprocessor within a predetermined time range in accordance with a random process. However, the transmission of the signal always takes place before the next measured value is recorded. This time variation gives the advantage that, with two monitoring devices which are operated simultaneously at a short distance and which monitor different breathing apparatuses, a collision of transmitted signal values can only occur by accident. If the time interval between measuring interval and transmission interval are always the same, the unfavorable situation could arise in which the values emitted by two transmitting elements collide with one another over a relatively long period of time.

As soon as a predetermined switch-off criterion is fulfilled, the transmitter is switched back into the standby mode, which is shown in time period 49. The switch-off criterion is present if no further pressure reduction is determined for a predetermined number of measuring intervals.

The signal transmission from the transmitter 2 to the receiver 3 takes place by means of an electromagnetic radio wave of constant frequency. The quartz-controlled timer 21 serves to control the transmission frequency. Since the frequency of the oscillator quartz is 32,768 Hz, the structure of the transmitting element is made simpler if a frequency is used which is derived from this frequency with the divisor $2^n$. The frequencies 32,768 (n=0), 16,384 (n=1), 8,192 (n=2) and 4,096 (n=3) are particularly preferred. Tests have shown that a particularly good data transmission is achieved under water by using a carrier frequency of 8,192 hertz.

In the interests of fault-free data transmission, the data signals to be transmitted are digitally encoded in the transmitting element 2. In the prior art there are various processes for transmitting the digital values, with which processes the frequency, the amplitude or the phase position of the carrier signal are changed.

A known method, which could also be used for the monitoring device of the type shown, is to change the frequency of the transmission signal with the so-called frequency shift keying. In this method, different frequencies are assigned to the bit information contents 0 and 1. However, this requires two frequencies to be transmitted which increases the complexity with regard to the transmitter and receiver.

The best possible type of transmission has proven to be influencing the phase position with the so-called phase shift keying (PSK), in which case in the present exemplary embodiment a further particular variant of the PSK method is used, namely the differential phase shift keying (DPSK).

In this method, the transmission signal experiences a phase jump if a 1 is transmitted; if a 0 is transmitted, the transmission signal remains unchanged. Since, in this method, the first bit of the transmitted bit pattern contains an uncertainty, it must not be used as information carrier.

Figure 4:
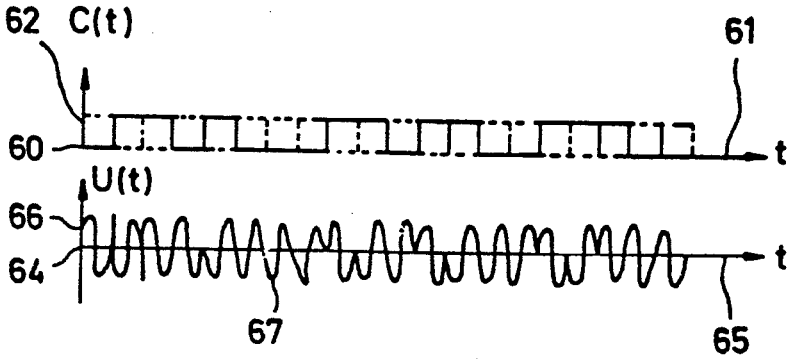
FIG. 4 shows a diagrammatic view of the encoding of the transmission signal of the exemplary embodiment according to FIG. 1.

An example of this digital encoding is illustrated in FIG. 4. Here, a bit pattern consisting of the bits 0110100011 . . . is illustrated in the diagram 60 against a time axis 61 and a number axis 62.

In the diagram 64, a voltage signal 67 is plotted against the identically scaled time axis 65 and the voltage axis 66 and has a constant frequency, but on which the bit pattern is impressed by the prescribed DPSK modulation as a phase change.

Within each transmission interval, a signal sequence is transmitted which, as is shown by FIG. 5, is built up of a preamble, the identification signal, a data block and a postamble. The preamble serves to permit the receiver to synchronize to the transmitted signal. The identification code contains the transmitter-specific identification. The actual data block to be transmitted adjoins the identification code. In every case, the data block contains the measured pressure value but, in a preferred embodiment, it can also contain a temperature value which is detected via a corresponding temperature sensor. Furthermore, it is possible to transmit in this data block the breathing frequency derived for example from the measurement of the pressure signal. Of course, other data can also be transmitted if this is of interest for a specific application. This is adjoined by the postamble which serves inter alia for error correction.

In the illustrated exemplary embodiment, the synchronization interval comprises 16 bits, the identification code 24 bits, the data block 32 bits and the postamble 4 bits. Each signal is therefore 76 bits long.

Tests have shown that it is favorable for the DPSK used to emit a total of 8 periods of the carrier frequency at 8196 hertz per bit. As a result, period of emission of a total of 0.976 msec/bit or a total signal duration of approx. 74 msec. is obtained.

Figure 7:
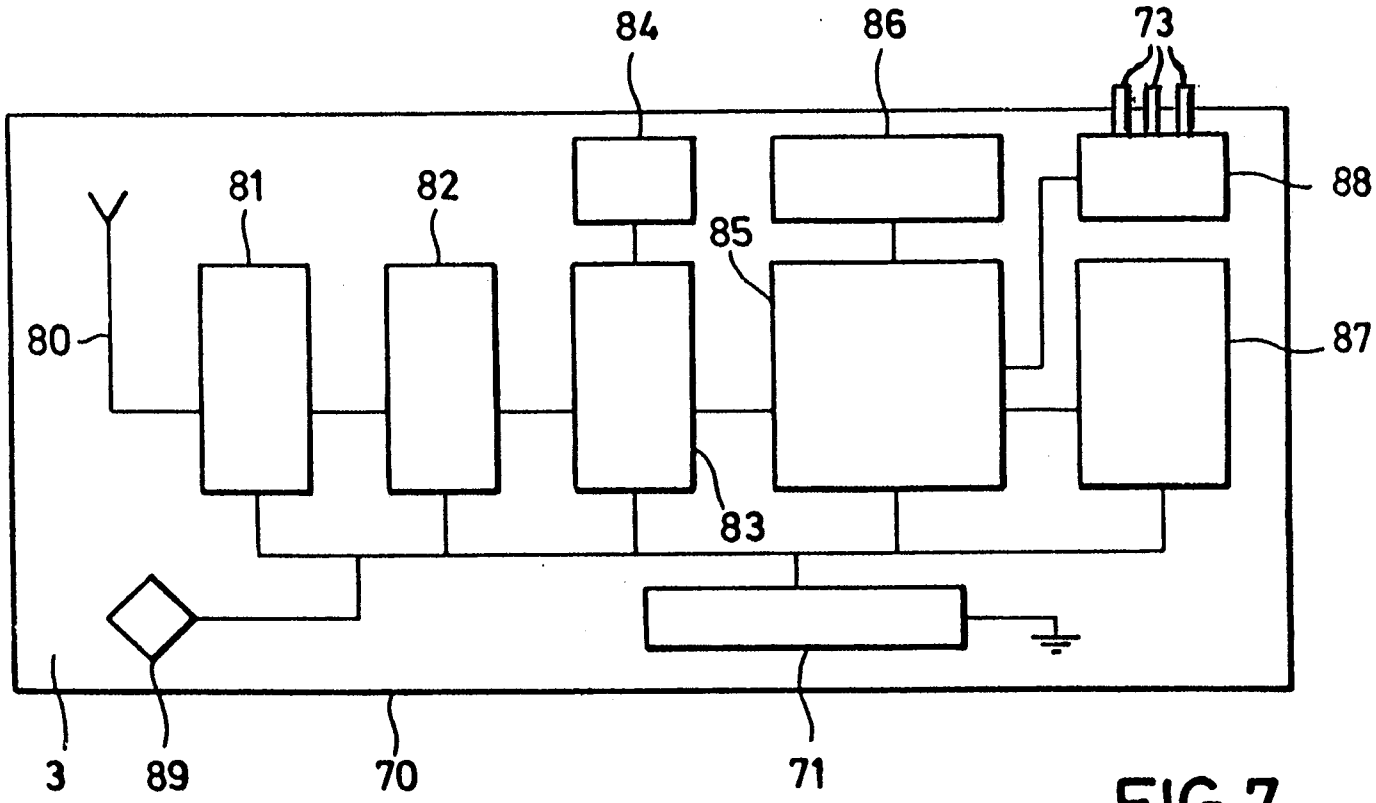
FIG. 7 shows a diagrammatic view of the receiving element of the exemplary embodiment according to FIG. 1.

The structure of the receiving element is now described with reference to FIG. 7.

The receiving element 3 is accommodated separately from the transmitting element in a plastic housing 70 and does not have any connection, of mechanical type or by means of electrical lines, to the transmitting element 2. The plastic housing 70 is filled with electrically non-conductive oil, silicone or the like and has a battery 71 in order to supply the electrical and electronic components with electrical power. In addition, there is a flexible strap (not illustrated) arranged on the housing 70, which strap permits the user to secure the receiving element on his wrist like a wrist watch.

The housing is designed in such a way that it withstands the water pressure even at the greatest depths which may be reached by divers and has no movable electrical switching devices on its exterior in contact with the water. In order to be able to activate the device and to confirm assignment in pairing mode, however, a plurality of electrically conductive metal pins 73 are let into the housing, which pins can be spanned by the diver, for example with his fingers, which is interpreted by the receiving element under specific circumstances as a switching event.

The receiving element has one or two ferrite aerials 80 as illustrated diagrammatically in the figure. The received signal is initially fed to a signal processing and amplification step 81 which is adjoined by a digitization step 82. Both constructional elements correspond to usual designs.

The digital signal is fed to a comparator 83. This comparator determines whether the received and preprocessed signal contains the identification signal or the identification control signal. If this is the case, the signal is fed to a microprocessor 85 which, controlled via a program stored in a memory 86, assumes the further processing.

The use of the upstream comparator step has the advantage that the microprocessor 85 is only fed with the signal when it is clear that the individual receiver has been addressed.

The time control of the receiving element takes place via a timer 84.

The data derived from the received signal and, if appropriate, further data are displayed to the user in the display 87. The display 87 is arranged for this purpose behind a transparent area in the wall of the housing 70 of the receiving element 3. The pressure prevailing in the bottle 5 and preferably also the remaining breathing time are displayed on the display. For this, a further pressure sensor 89 is required which measures the respective ambient pressure. The remaining breathing time is determined in that the current air consumption is determined by the microprocessor from the pressure reduction measured per unit of time taking into account the ambient pressure. The air consumption can be averaged here for a period of time which has just elapsed or over a relatively long period of time in order to obtain realistic values. From this, the expected time for the air supply to run out completely is extrapolated.

The respective data are displayed in the display until new data are determined after a renewed measurement and the transmission of values.

The receiver also has a switching device 88 (illustrated only diagrammatically) with the metal pins 73 already mentioned. The metal pins 73 can also be arranged at a relatively large distance from one another or at different sides of the housing in order to prevent accidental bridging of the contacts.

Below, it is described how the assignment or the pairing of transmitting element and receiving element is carried out within the identification change mode.

As already explained, during manufacture an identification signal, which is only ever allocated once, is permanently assigned to each transmitting element. In the present exemplary embodiment, a 24-bit signal is used for this, from which a total of 16.7 million different identification possibilities are obtained. By virtue of this high number it is ensured that no two transmitting elements have the same signal.

The identification signal of the transmitting component is stored in a ROM area of the memory 23 of the transmitting element 2. It is also possible to store the identification signal in a RAM area; in this case, the signal must however be fixed elsewhere in the device for example by means of the simultaneous use as a manufacturer's number so that the signal can be correctly read in again in the event of a battery change.

The identification change mode is started whenever the transmitting element is activated. This occurs, as explained above, preferably by means of a fixed switched-on criterion, for example the opening of the apparatus valve 6 of the bottle 5. The transmitting element then goes into the identification change mode and transmits, as illustrated in FIG. 6, a signal which consists of a preamble, an identification control signal, the actual identification signal and a postamble. In the exemplary embodiment, the preamble is 16 bits long, the postamble 4 bits long and the identification control signal and the identification signal 24 bits long each.

The identification control signal is understood by all receiving elements of the corresponding types. As soon as a receiving element receives this signal it is switched over via the microprocessor into the identification change mode. The processor then inquires via the display whether the identification signal of the transmitting element is to be taken over. If this is confirmed by the user via the switching device 88 by means of the metal pins 73, the identification signal of the transmitting element is taken over and stored in the memory 86 as an identification comparison signal.

The control program of the receiving element stored in the memory 86 can be designed in such a way that as soon as it receives the identification control signal of the transmitting element in the identification change mode the receiving element tests whether its stored identification comparison signal matches the identification signal of the transmitting element. If this is the case, the receiving element can then indicate that it is set to this transmitting element so that the user knows that the two devices are assigned to one another.

In order to avoid an accidental assignment of devices, the identification control mode in the exemplary embodiment has a plurality of safety steps.

The first step is the coupling of the start of the identification change mode to the switch-on criterion of the transmitting element. The identification change is always performed only directly after the occurrence of the switch-on criterion. In this way, an identification change is reliably prevented from being started during the normal use of the devices.

As a second safety step, a power measurement of the signal received in the identification change mode is carried out by the receiving element with a corresponding device. The program of the receiving element is therefore designed in such a way that a power measurement of the entire signal is carried out whenever the identification control signal is received. Only if the transmission power exceeds a specific threshold value is an assignment possible.

The transmission of the power from the transmitting element to the receiving element depends, as known, on the distance and, to a considerable degree, also on the respective alignment of the two aerials in relation to one another. Only if the devices are arranged in a specific way with respect to one another in terms of angle and space is the power absorbed by the receiving element at a maximum. The threshold value for the power measurement is therefore selected in such a way that an assignment can only take place if the transmitting and receiving elements are arranged at a small distance in relation to one another and, in addition, have a predetermined angular alignment in relation to one another. In order to simplify the angular assignment, the aerials of the transmitting element and receiving element are preferably arranged in the respective housing in such a way that the maximum power is obtained with a parallel or T-shaped arrangement of the devices in relation to one another. In order to exclude random occurrences here also, the transmission of the identification control signal is repeated several times and an adequate signal power is then only assumed if the measured value lies above the threshold value over a specific percentage of the transmissions.

Finally, the user must also actuate the switching device 88, and this constitutes the next safety step, in order to confirm the identification change. For this, for example the three metal pins must be used in such a way that only two can be spanned in the case of an identification change mode. In this way, an identification assignment under water (in this case all three metal pins would be electrically connected) is prevented from taking place. It is also possible to use three metal pins in such a way that initially a first pair and then a second pair have to be spanned.

An assignment therefore only takes place if 1. the transmitting and receiving elements are arranged virtually directly next to one another in a defined angular position;
2. in this state, the shut-off valve of the air bottle is opened;
3. and the identification is manually confirmed by the user.

It is described below how the illustrated receiver tests the plausibility of the received data.

As stated at the beginning, the monitoring device should, as far as possible, not display false values, even for only a short period of time. Due to the wireless transmission, it may however occur that the reception of the entire signal transmitted during a transmission interval, or parts of the signal, is adversely affected, for example by vigorous movements of the user or the like.

If two transmitting elements operate in close proximity to one another, it could also occur that the two transmitting elements transmit essentially at the same time so that the signals are superimposed upon one another and thus can no longer be clearly identified.

Furthermore, it could be the case, even though this is improbable, that due to the superimposition of different signals for a short period of time a pattern is produced which happens to correspond to the identification signal.

This problem can be counteracted by suppressing the appropriate display whenever the signal has not been received absolutely correctly.

In the exemplary embodiment shown, a plausibility check is provided as an additional safety measure in order to exclude any risk of an incorrect display. The plausibility check takes place by the calculation of the pressure drop to be expected in the bottle of the breathing apparatus by the microprocessor of the receiving element.

When in use, breathing air is removed from the breathing apparatus essentially continuously and the pressure in the bottle 5 drops continuously in a corresponding fashion, from which the current air consumption is determined. By reference to the air consumption, the microprocessor calculates how the pressure drop in the bottle would have to drop further with a continuous removal of air. At each pressure measurement, it can then be determined whether the newly measured pressure is plausible with respect to the previously measured pressure values. If this is the case, the new pressure value is displayed in the display. If the pressure value is not plausible or if no signal or no complete signal is received in the predetermined time interval, either no pressure value is displayed or the last pressure value measured is displayed but it is indicated by means of an additional symbol or for example by flashing of the display but this is the result of a previous pressure measurement.

If no pressure signal is received over a plurality of measuring intervals or if the signal is not clearly identifiable as a result of faults, this display is retained until a time frame fixed in the control program of the microprocessor 86 is exceeded. From this time point onwards, it is assumed that reliable pressure values are no longer available and the calculation of the air consumption is terminated. This is indicated accordingly in display 87.

If pressure signals are received again which originate from the transmitting element assigned to the receiving element, these are displayed but with an additional symbol, for example with a flashing display or the like, by means of which the user is informed that a plausibility check of these values is no longer possible.

Figure 8:
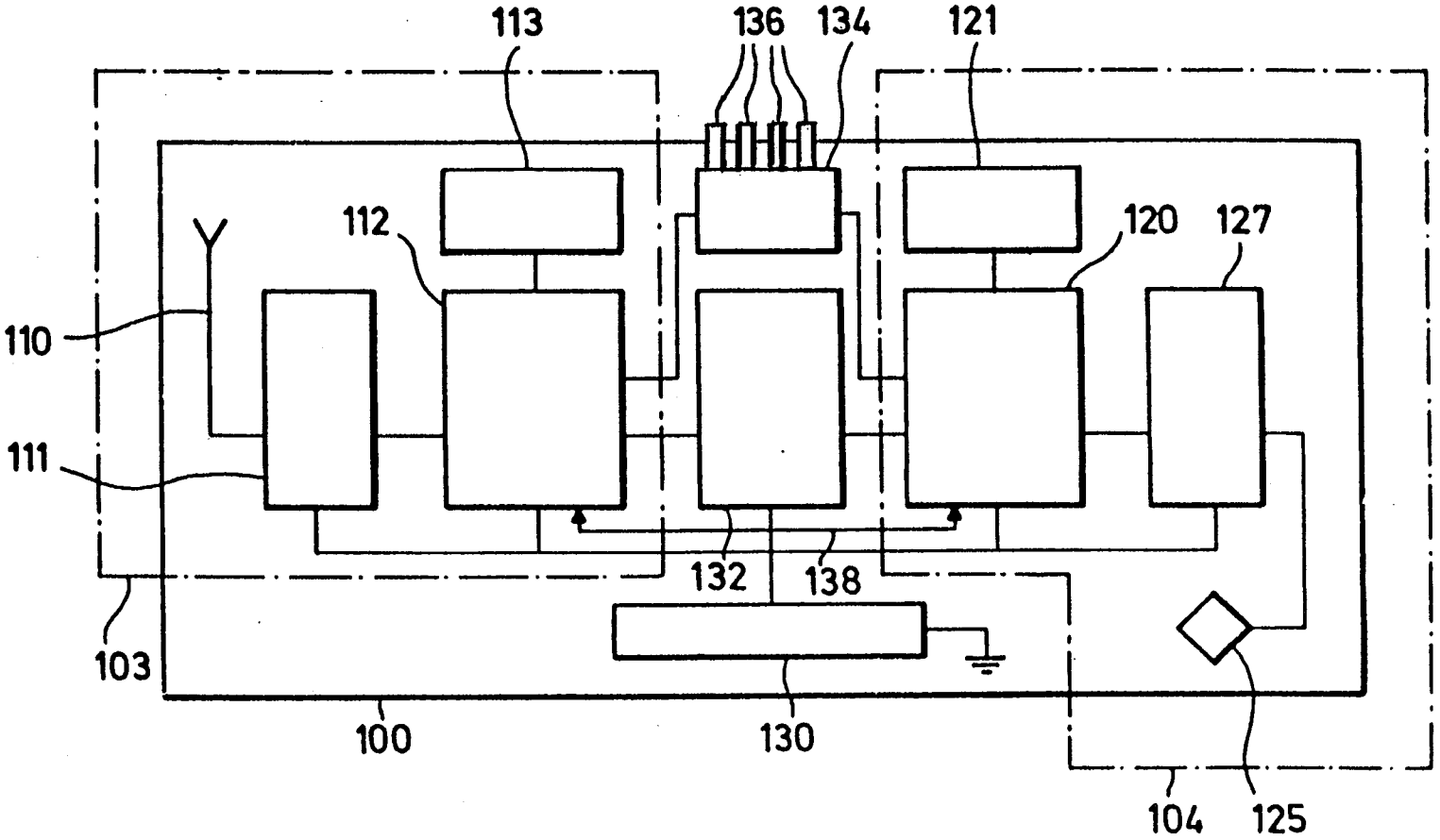
FIG. 8 shows a diagrammatic view of a further exemplary embodiment of the invention in which the receiver is combined with a decompression computer.

In a further exemplary embodiment of the monitoring device according to the invention which is illustrated diagrammatically in FIG. 8, the monitoring device is combined with a decompression computer. The decompression computer could be arranged both in the transmitting device and in the receiving device. However, as in the exemplary embodiment shown, the receiving element of the monitoring device and the decompression computer are preferably combined with one another in a housing since the decompression computer then remains functional even in the event of a failure of the transmitter.

Decompression computers of the type in question here are known in the prior art. The applicant has already marketed devices of this kind for example in relatively large numbers in 1989 in Europe, USA, Japan, Australia and many other countries, for example under the name "Aladin pro". In decompression computers of this type, the current ambient pressure, which is a measure for the diving depth, and the entire diving time are detected via a corresponding manometer and a time measuring device. With these input values the saturation and desaturation behavior of a specific number, for example 6 or 16, of different tissues is simulated by means of a microprocessor with a program stored in a memory. By comparing the stressing of the individual tissues the computing unit calculates which tissue, the so-called control tissue, is indicative of the decompression and accordingly determines the number, the depth and the respective duration of the necessary decompression steps. At the same time, the entire diving time, the current diving depth, the respective next decompression stop and the entire time which is necessary to reach the water surface at a specific predetermined ascent speed and with the prescribed decompression steps are displayed to the diver on a display. Furthermore, the decompression computer is provided with memory devices, a so-called log book in which the diving profile of previous dives is stored so that the diver can make a note of his respective diving times etc. after leaving the water. Moreover, such a decompression computer is provided with a device for measuring the air pressure before diving so that the device can be used even in lakes which lie at a higher altitude than sea level and fluctuations in air pressure can be prevented from influencing the measurement results.

It is possible to combine the receiving element of the monitoring device according to the invention and the computing unit for the decompression calculation in such a way that both are controlled by a common microprocessor.

However, the programing and the design are simplified if a solution with two microprocessors is used instead.

The exemplary embodiment of the monitoring device according to the invention shown in FIG. 8 operates with a transmitting element such as explained with reference to FIG. 2 and therefore no longer illustrated in FIG. 8. The receiving element has a pressure-tight, non-magnetic housing 100 in which, as is indicated by the area shown by dot-dash lines, the receiver 103 and the decompression computer 104 are arranged together. The housing is filled with oil and has an internal pressure which is equal to the pressure of the water surrounding the housing. The dimensions of a pattern of this housing which is designed to be carried on the wrist are approximately 75 mm (length transversely to the direction of the arm) and approximately 75 mm in width, measured along the arm. The housing has a thickness of approximately 20 mm.

The receiving element 103 is constructed as described above and has an aerial 110 and a first microprocessor 112 with a memory 113. The components serving essentially for signal processing are combined diagrammatically in the constructional unit 111.

The decompression computer has a microprocessor 120 with a memory 121 for program and data. The pressure of the surrounding water is detected via a pressure sensor 125. The other electrical components, such as timer etc., are combined diagrammatically in the constructional unit 127.

At least the battery 130 serving to supply power, a display 132 let into the housing wall and a switching device 134 with four metal pins 136 are provided as common constructional elements.

A common display-monitoring device and a common timer and the like can be used as further common constructional elements.

The microprocessors are each controlled via a separate program but exchange data via a diagrammatically indicated data line 138. From this, the following data are determined and presented on the display 132 with numbers and/or symbols:

the pressure in the breathing air bottle in bar or psi;

the time remaining for the stay at the respective diving depth, taking into account the time required for the ascent (remaining air time) in minutes or with a symbol, for example an emptying hourglass;

the entire diving time from entry into the water;

the current diving depth;

the next decompression stop and the first decompression time to be spent there;

the entire diving time;

the maximum diving depth;

the current ascent speed.

In addition, the following functions or incorrect functions can be displayed or indicated by the flashing of the corresponding values or by additional visual and/or acoustic warnings:

a signal, for example a flashing of the pressure display, which indicates that the current displayed bottle pressure is not being monitored by the air consumption prognosis since the connection between the transmitting component and the receiving component has been disconnected for a relatively long time;

a display for a brief interruption of the connection between the transmitting component and receiving component;

a signal when the maximum ascent speed exceeds the permitted value (this value can be determined with the pressure sensor 125 by pressure measurements occurring at brief time intervals).

Furthermore, in accordance with this exemplary embodiment the monitoring device can also be coupled to displays which only become visible after leaving the water, for example a warning display in the form of an aircraft which indicates to the diver that the use of an aircraft is not yet possible again, a log book display, etc.

The decompression data are determined, as described above, by the microprocessor 120 via the simulation of the behavior of a specific number of types of tissue. The admissible time spent at a specific depth is obtained by means of a, for example, iteratively occurring approximation in which the previously computed time for which the air supply is still adequate is divided up into the remaining time spent at a particular depth and into the overall ascent time which is necessary to rise to the surface from this depth after the bottom time has expired.

In addition to the input variables of pressure and time, the calculated air consumption can also be taken into account in the decompression calculation. Since the air consumption is a measure of the physical exertion of the diver the influence of physical exertion on the decompression times can thus be taken into account in accordance with the results of medical research into diving.

We claim:

1. A monitoring device for portable breathing apparatuses having:

a manometer which detects the pressure in one or more air supply pressure containers of the breathing apparatus by means of a pressure sensor and emits an electrical pressure signal which is representative of the pressure;

a transmitter which receives the pressure signal emitted by the manometer and transmits a transmission signal corresponding to the pressure signal;

a receiver which receives the transmission signal emitted by the transmitter;

a display device which is coupled to the receiver and displays data as numbers or symbols which are derived at least partially from the transmission signal received by the receiver, wherein, the transmitter has a convertor device which encodes the electrical pressure signal to be transmitted by the transmitter in digital form, and a control device which automatically causes the transmission signals to be transmitted at predetermined time intervals, the transmitter has a signal generating device which generates and stores an identification signal which is characteristic of the transmitter and unambiguously identifies said transmitter, the control device causes said identification signal to be emitted at least once within each transmission interval, the receiver has a memory in which an identification comparison signal, which is assigned to that of the transmitter, is stored, and the receiver has a comparison device which tests whether the identification signal emitted by the transmitter matches the identification comparison signal stored in the receiver, and the transmission signals received by the receiver are only passed on or further processed if the identification signal received from the transmitter and the identification comparison signal stored in the receiver are identical, wherein at least one of (1) the identification signal stored in the transmitter and (2) the identification comparison signal stored in the receiver is variable in order to match the identification signal of the transmitter and the identification comparison signal of the receiver with one another and that modification of the identification signal is always triggered by one of the transmitter and the receiver.

2. A monitoring device for portable breathing apparatuses having:

a manometer which detects the pressure in one or more air supply pressure containers of the breathing apparatus by means of a pressure sensor and emits an electrical pressure signal which is representative of the pressure;

a transmitter which receives the pressure signal emitted by the manometer and transmits a transmission signal corresponding to the pressure signal;

a receiver which receives the transmission signal emitted by the transmitter;

a display device which is coupled to the receiver and displays data as numbers or symbols which are derived at least partially from the transmission signal received by the receiver, wherein, the transmitter has a convertor device which encodes the electrical pressure signal to be transmitted by the transmitter in digital form, and a control device which automatically causes the transmission signals to be transmitted at predetermined time intervals, the transmitter has a signal generating device which generates and stores an identification signal which is characteristic of the transmitter and unambiguously identifies said transmitter, the control device causes said identification signal to be emitted at least once within each transmission interval, the receiver has a memory in which an identification comparison signal, which is assigned to that of the transmitter, is stored, and the receiver has a comparison device which tests whether the identification signal emitted by the transmitter matches the identification comparison signal stored in the receiver, and the transmission signals received by the receiver are only passed on or further processed if the identification signal received from the transmitter and the identification comparison signal stored in the receiver are identical, wherein at least one of (1) the identification signal stored in the transmitter and (2) the identification comparison signal stored in the receiver is variable in order to match the identification signal of the transmitter and the identification comparison signal of the receiver with one another and wherein an identification control signal is generated by the signal generating device of the transmitter, an identification control comparison signal is stored in the memory of the receiver and the comparison device switches over the receiver into an identification signal change mode as soon as the comparison device recognizes that an identification control signal emitted by the transmitter is identical to the identification control comparison signal stored in the receiver.

3. The monitoring device as claimed in claim 2, wherein at least the control device and the signal generating device of the transmitter are combined in a first microprocessor device which is controlled by a program stored in memory.

4. The monitoring device as claimed in claim 2, wherein the receiver has a microprocessor unit which is controlled by a program which is stored in the memory arranged in the receiver.

5. The monitoring device as claimed in claim 4, wherein an expected reduction in the pressure or in breathing air in the pressure container is extrapolated from current breathing air consumption by means of the microprocessor device of the receiver.

6. The monitoring device as claimed in claim 5, wherein, in the case of a brief disconnection of the connection between the transmitter and the receiver, a newly received measured pressure value is compared with the extrapolated pressure value and displayed if the extrapolated pressure value and measured pressure value differ by a predetermined amount.

7. The measuring device as claimed in claim 5, wherein a length of time the breathing air supply is expected to last is determined from the extrapolated reduction in breathing air and said length of time is displayed.

8. The monitoring device as claimed in claim 4, wherein the microprocessor device of the receiver carries out at least partially a function of a signal power measuring device via the program stored in the memory.

9. The device as claimed in claim 2, wherein the identification signal is stored in the transmitter as a digital number sequence with n bits and the identification comparison signal is stored in the receiver also as a digital number sequence with n bits.

10. The monitoring device as claimed in claim 2, wherein the transmitter has a first detector device which recognizes the occurrence of a predetermined condition and switches over the transmitter from a transmission mode, in which at least the pressure signal and the identification signal are emitted, into an identification signal change mode in which an identification control signal and the identification signal are emitted.

11. The monitoring device as claimed in claim 10, wherein the pressure signal measured by the manometer is fed to the first detector device and the latter recognizes as a predetermined condition when the pressure measured by the manometer rises by a predetermined value within a predetermined period of time.

12. The monitoring device as claimed in claim 2, wherein the receiver has a signal power measuring device with which the power of the signal received from the transmitter is measured at least whenever the comparison device detects that an identification control signal transmitted by the transmitter is identical to the identification control comparison signal stored in the receiver.

13. The monitoring device as claimed in claim 2 wherein the transmission of the transmission signal from the transmitter to the receiver takes place by means of ultrasonic sound.

14. The monitoring device as claimed in claim 2, wherein the transmission of the signals from the transmitter to the receiver takes place by means of electromagnetic waves.

15. The monitoring device as claimed in claim 14, wherein the frequency of the electromagnetic waves lies in the range, of between 5 and 100 kilohertz.

16. The monitoring device as claimed in claim 15, wherein the transmission of the data takes place via a change in the phase position of a sinusoidal signal.

17. The monitoring device as claimed in claim 2, wherein the transmitter has a timer unit and is controlled in such a way that the manometer measures the pressure in predetermined, fixed time intervals.

18. The monitoring device as claimed in claim 17, wherein the transmitter has a second detector device which recognizes an occurrence of a specific event and which switches over the transmitter from a passive standby mode into an active transmission mode when this event occurs, and wherein a third detector device is further provided which recognizes that the measured pressure value does not change over a predetermined number of successive pressure measurements and which switches over the transmitter from the active mode into the passive mode.

19. The monitoring device as claimed in claim 18, wherein a first microprocessor device of the transmitter carries out at least partially, via a program stored in memory of the microprocessor, functions of at least one of (1) the manometer, (2) the convertor device, (3) one of the first, the second or the third detector devices and (4) the random circuit.

20. The monitoring device as claimed in claim 2, wherein both the transmitter and receiver are each arranged in a pressure-tight, oil-filled housing so that the monitoring device can be used under water.

21. The monitoring device as claimed in claim 20, which is to be carried by a user during a dive under a surface of water, wherein the receiver is coupled to a decompression computing unit which is connected to a second manometer and to a timer and, by means of a predetermined program stored in a memory of the decompression computing unit, calculates, taking into consideration times spent at different diving depths, how long the user requires to reach the surface of the water without the risk of decompression sickness, in which case at least one of (1) overall resurfacing time, (2) next decompression stop and time to be spent there or (3) that maximum admissible ascent speed has been exceeded, are displayed to the user.

22. The monitoring device as claimed in claim 21, wherein the receiver and decompression computing device have separate microprocessor devices.

23. The monitoring device as claimed in claim 21, wherein the microprocessor device of the receiver and the decompression computing device, respectively, calculate and display, from extrapolated time, time for which the air supply will still last and, from determined overall diving time, time which the user may still spend at a respective diving depth.

24. The monitoring device as claimed in claim 21, wherein the receiver and decompression computing device have a common microprocessor device.

25. The monitoring device as claimed in claim 21, wherein a result of an air consumption measurement is fed to the decompression computing unit as a further input variable whereby the air consumption is taken into account in the calculation of decompression parameters.

26. The monitoring device as claimed in claim 21, wherein the microprocessor device of the receiver calculates and displays, from extrapolated time, time for which the air supply will still last and, from a determined overall diving time, a time which the diver may still spend at a respective diving depth.

27. The monitoring device as claimed in claim 2, wherein the receiver and display device are arranged in a common housing which is attached to an arm or wrist area of a user with attachment means.

28. A monitoring device for portable breathing apparatuses having:

a manometer which detects the pressure in one or more pressure containers of the breathing apparatus by means of a pressure sensor and emits an electrical pressure signal which is representative of the pressure;

a transmitter which receives the pressure signal emitted by the manometer and transmits a transmission signal corresponding to the pressure signal;

a receiver which receives the transmission signal emitted by the transmitter;

a display device which is coupled to the receiver and displays data as numbers or symbols which are derived at least partially from the transmission signal received by the receiver, wherein, the transmitter has a control device which causes the transmission signals to be transmitted at intervals;

the transmitter has a signal generating device which generates and stores an identification signal which is characteristic of the transmitter and unambiguously identifies the said transmitter;

the control device causes said identification signal to be emitted at least once within each transmission interval;

the receiver has a memory in which an identification comparison signal, which is assigned to that of the transmitter, is stored, and the receiver has a comparison device which tests whether the identification signal emitted by the transmitter matches the identification comparison signal stored in the receiver;

the transmission signals received by the receiver are only passed on or further processed if the identification signal received from the transmitter and the identification comparison signal stored in the receiver are identical;

at least one of the identification signal stored in the transmitter and the identification comparison signal stored in the receiver is variable in order to match at least one of the identification signal and the identification comparison signal of the transmitter and receiver with one another;

an identification control signal is generated by the signal generating device of the transmitter, an identification control comparison signal is stored in the memory of the receiver and the comparison device switches the receiver over into an identification signal change mode as soon as the comparison device recognizes that an identification control signal emitted by the transmitter is identical to the identification control comparison signal stored in the receiver; and the receiver has a manually actuable switching device and an identification signal received during the identification change mode is only stored by the receiver if this manual switching device is actuated.

29. Monitoring device as claimed in claim 28, wherein the switching device has electrical contact pins consisting of metal which are conducted through an electrically non-conductive housing region of the receiver and can be touched from the outside.

30. Monitoring device as claimed in claim 28, wherein the receiver only stores an identification signal received during the identification change mode if the power of the received transmission signal lies above a specific predetermined value and if the switching device is actuated.

* * * * *